US010423085B2

(12) United States Patent
Takemori

(10) Patent No.: US 10,423,085 B2
(45) Date of Patent: Sep. 24, 2019

(54) TONER, IMAGE FORMING APPARATUS, AND IMAGE FORMING METHOD

(71) Applicant: KYOCERA Document Solutions Inc., Osaka (JP)

(72) Inventor: Toshiki Takemori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/190,195

(22) Filed: Nov. 14, 2018

(65) Prior Publication Data

US 2019/0163079 A1 May 30, 2019

(30) Foreign Application Priority Data

Nov. 29, 2017 (JP) ..... 2017-228656

(51) Int. Cl.

| | |
|---|---|
| ***G03G 9/08*** | (2006.01) |
| ***G03G 9/087*** | (2006.01) |
| ***G03G 9/097*** | (2006.01) |
| ***G03G 21/00*** | (2006.01) |

(52) U.S. Cl.

CPC ..... *G03G 9/0815* (2013.01); *G03G 9/0819* (2013.01); *G03G 9/08764* (2013.01); *G03G 9/09791* (2013.01); *G03G 21/0011* (2013.01); *G03G 9/08708* (2013.01); *G03G 2221/0005* (2013.01)

(58) Field of Classification Search

CPC ..... G03G 9/0815; G03G 9/0819; G03G 21/0011; G03G 9/09791; G03G 9/08764; G03G 9/08708; G03G 2221/0005

See application file for complete search history.

(56) References Cited

U.S. PATENT DOCUMENTS

| | | | | |
|---|---|---|---|---|
| 8,574,800 | B2 | 11/2013 | Okita et al. | |
| 2010/0330482 | A1 | 12/2010 | Okita et al. | |
| 2013/0029259 | A1* | 1/2013 | Tujihiro ..... | G03G 5/043 430/108.3 |

FOREIGN PATENT DOCUMENTS

| | | | |
|---|---|---|---|
| JP | 2011-008129 | A | 1/2011 |

* cited by examiner

*Primary Examiner* — Thorl Chea

(74) *Attorney, Agent, or Firm* — Studebaker & Brackett PC

(57) ABSTRACT

A toner includes a plurality of toner particles and a plurality of lubricant particles. The lubricant particles each include a core and a coat layer covering a surface of the core. The core contains stearic acid, palmitic acid, or a combination thereof. The coat layer has a thickness of at least 10 nm and no greater than 50 nm.

6 Claims, 2 Drawing Sheets

TONER, IMAGE FORMING APPARATUS, AND IMAGE FORMING METHOD

INCORPORATION BY REFERENCE

The present application claims priority under 35 U.S.C. § 119 to Japanese Patent Application No. 2017-228656, filed on Nov. 29, 2017. The contents of this application are incorporated herein by reference in their entirety.

BACKGROUND

The present disclosure relates to a toner, an image forming apparatus, and an image forming method.

According to electrophotography, a surface of an electrophotographic photosensitive member (also referred to below as a photosensitive member) as an image bearing member is charged and then exposed to light to form an electrostatic latent image on the photosensitive member. Subsequently, the electrostatic latent image is developed into a toner image with developer and the toner image is transferred to a transfer target (specific examples include an intermediate transfer belt and a recording medium). A substance such as a toner component remains on the surface of the photosensitive member after transfer of the toner image. The remaining substance (also referred to below as a residue) is accordingly removed for example through friction between the surface of the photosensitive member and a cleaning member such as a cleaning blade that is in pressure contact with the surface of the photosensitive member.

The cleaning member is made from an elastic material such as rubber. Therefore, an edge of the cleaning member may warp when friction force with the surface of the photosensitive member (surface of a photosensitive layer) is strong in residue removal. In particular, warping of the cleaning member tends to be caused in a situation using a photosensitive member including at the surface layer portion thereof a photosensitive layer containing amorphous silicon (also referred to below as an amorphous silicon photosensitive member). Presumably, the photosensitive layer of the amorphous silicon photosensitive member is hard to increase friction force between the cleaning member and the surface of the photosensitive layer.

When the cleaning member warps, power to remove a residue on the surface of the photosensitive member (cleaning ability) may impair. When cleaning ability of the cleaning member impairs, an image defect (for example, an image void) may be caused due to the presence of a residue that has not been removed in image formation.

A technique of adding a lubricant to a toner has been studied in order to inhibit warping of the cleaning member. For example, a toner including fatty acid metal salt particles as a lubricant has been studied. With use of the toner, lubrication of the fatty acid metal salt particles can decrease friction force between the cleaning member and the surface of the photosensitive member, resulting in inhibition of warping of the cleaning member.

SUMMARY

A toner according to the present disclosure includes a plurality of toner particles and a plurality of lubricant particles. The lubricant particles each include a core and a coat layer covering a surface of the core. The core contains stearic acid, palmitic acid, or a combination thereof. The coat layer has a thickness of at least 10 nm and no greater than 50 nm.

An image forming apparatus according to the present disclosure includes an image bearing member, a development device, a transfer device, and a cleaning member. The development device develops an electrostatic latent image formed on a surface of the image bearing member into a toner image with a developer. The transfer device transfers the toner image to a transfer target. The cleaning member is in pressure contact with the surface of the image bearing member after transfer of the toner image and removes a substance remaining on the surface of the image bearing member. The developer includes the toner according to the present disclosure.

An image forming method according to the present disclosure includes developing, transferring, and removing. In the developing, an electrostatic latent image formed on a surface of an image bearing member is developed into a toner image with a developer including the toner according to the present disclosure. In the transferring, the toner image is transferred to a transfer target. In the removing, a substance remaining on the surface of the image bearing member is removed using a cleaning member in pressure contact with the surface of the image bearing member after the transferring the toner image.

DETAILED DESCRIPTION

Figure 1:
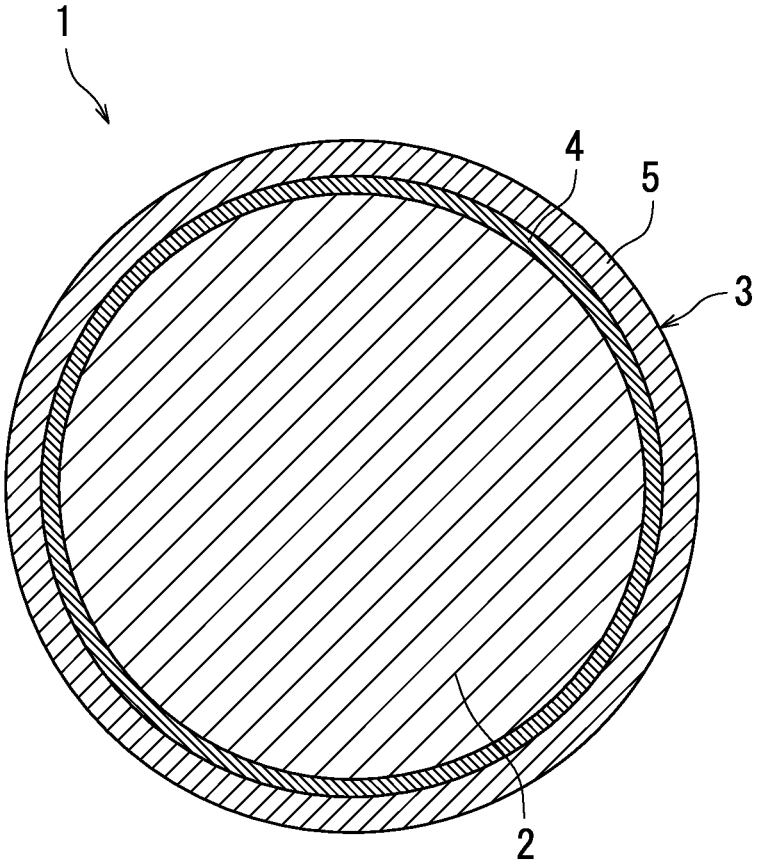
FIG. 1 is a diagram illustrating an example of a sectional structure of a lubricant particle included in a toner according to a first embodiment of the present disclosure.

Hereinafter, embodiments of the present disclosure will be described. Note that unless otherwise stated, evaluation results (for example, values indicating shape and physical properties) for a powder (specific examples include toner particles and lubricant particles) each are a number average of values measured for a suitable number of particles selected from the powder. A measured value for volume median diameter ($D_{50}$) of a powder is a median diameter measured using a laser diffraction/scattering particle size distribution analyzer ("LA-950V2", product of HORIBA, Ltd.), unless otherwise stated. Unless otherwise stated, a number average particle diameter of a powder is a number average value of equivalent circle diameters of primary particles of the powder (diameters of circles having the same areas as projected areas of the primary particles) measured using a scanning electron microscope. The number average particle diameter of the powder is a number average value of equivalent circle diameters of for example 100 primary particles.

Measurement values for glass transition points (Tg) are values measured using a differential scanning calorimeter ("DSC-6220", produced by Seiko Instruments Inc.) in accordance with "Japanese Industrial Standard (JIS) K7121-2012", unless otherwise stated. On a heat absorption curve (vertical axis: heat flow (DSC signal), horizontal axis: temperature) measured using the differential scanning calorimeter, the glass transition point (Tg) corresponds to a temperature at an inflection point derived from grass transition (specifically, temperature at an intersection point of an extrapolation line of a base line and an extrapolation line of an inclined portion of the curve). Measurement values for softening points (Tm) are values measured using a capillary rheometer ("CFT-500D", product of Shimadzu Corporation), unless otherwise stated. On an S-shaped curve (vertical axis: temperature, horizontal axis: stroke) measured using the capillary rheometer, the softening point (Tm) corresponds to a temperature at a stroke value of "(base line stroke value+maximum stroke value)/2". Measurement values for acid values and hydroxyl values are values measured in accordance with "Japanese Industrial Standard (JIS) K0070-1992", unless otherwise stated. Measurement values for number average molecular weight (Mn) and mass average molecular weight (Mw) are values measured by gel permeation chromatography, unless otherwise stated.

The term "main component" of a material refers to a component having the largest content in the material in terms of mass, unless otherwise stated. Furthermore, chargeability refers to chargeability in triboelectric charging, unless otherwise stated. Positive chargeability (or negative chargeability) in triboelectric charging can be determined using a known triboelectric series.

In the following description, the term "-based" may be appended to the name of a chemical compound to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. The term "(meth)acrylonitrile" is sued as a generic term for both acrylonitrile and methacrylonitrile.

First Embodiment: Toner

A toner according to a first embodiment is suitable for use as a positively chargeable toner for development of electrostatic latent images. The toner according to the first embodiment includes a plurality of toner particles and a plurality of lubricant particles. The toner according to the first embodiment may be used as a one-component developer. Alternatively, a two-component developer may be prepared by mixing the toner and a carrier using a mixer (for example, a ball mill).

Each of the lubricant particles includes a core and a coat layer covering a surface of the core. The core of the lubricant particle contains stearic acid, palmitic acid, or a combination thereof. The coat layer of the lubricant particle has a thickness of at least 10 nm and no greater than 50 nm. The lubricant particles may be attached to surfaces of the toner particles. Alternatively, the lubricant particles may be configured to be transferred to a surface of a photosensitive member separately from the toner particles without being attached to the surfaces of the toner particles. In the latter case, selection of a material having the same charging polarity as that of the toner particles as a material of the coat layers for example can allow the lubricant particles to be transferred to the surface of the photosensitive member. Alternatively, a configuration in which external additive particles having the same charging polarity as that of the toner particles are attached to surfaces of the lubricant particles can allow the lubricant particles to be transferred to the surface of the photosensitive member. Thickness of the coat layers can be measured using a transmission electron microscope (TEM). An example of measuring methods using the TEM will be described later in Examples. Note that boundaries between the cores and the coat layers can be confirmed for example by selectively dying only the coat layers among the cores and the coat layers. In a situation in which the boundaries between the cores and the coat layers are indefinite in a TEM image, the boundaries between the cores and the coat layers can be defined by mapping characteristic elements contained in the coat layers in the TEM image through combination of TEM and electron energy loss spectroscopy (EELS).

With use of the toner according to the first embodiment having the above-described features, impairment in cleaning ability of a cleaning member can be inhibited while charge stability can be maintained. Presumably, the reason therefor is as follows.

The lubricant particles included in the toner according to the first embodiment each include the core containing stearic acid, palmitic acid, or a combination thereof (also referred collectively to below as a specific lubricant), each of which functions as a lubricant. The core is covered with the coat layer having a thickness of at least 10 nm. In the above configuration, even when the toner is stirred for example in a development device, attachment of the specific lubricant to a carrier or a member in the development device can be inhibited, with a result that variation in chargeability of the toner particles caused due to the specific lubricant can be inhibited. Thus, it is thought that charge stability can be maintained when the toner according to the first embodiment is used.

Furthermore, the cores containing the specific lubricant are covered with the coat layers having a thickness of no greater than 50 nm in the lubricant particles included in the toner according to the first embodiment. In the above configuration, the coat layers have not so excessively high strength, and therefore, tend to be readily broken by friction force between the cleaning member and the surface of the photosensitive member after transfer of the lubricant particles to the surface of the photosensitive member. When the coat layers are broken, the specific lubricant contained in the cores is applied onto the surface of the photosensitive member to decrease friction force between the cleaning member and the surface of the photosensitive member. As a result, the cleaning member hardly warps. Thus, it is thought that impairment in cleaning ability of the cleaning member can be inhibited.

The amount of the lubricant particles is preferably at least 0.01 parts by mass relative to 100 parts by mass of the toner particles in order to inhibit impairment in cleaning ability of the cleaning member, and more preferably at least 0.05 parts by mass. Furthermore, in order to easily maintain charge stability, the amount of the lubricant particles is preferably no greater than 1 part by mass relative to 100 parts by mass of the toner particles, and more preferably no greater than 0.5 parts by mass. The following describes the toner according to the first embodiment in detail with reference to drawings as appropriate. Specifically, the toner particles and the lubricant particles will be described in the stated order.

[Toner Particles]

The toner particles included in the toner according to the first embodiment may include an external additive. In a situation in which the toner particles include an external additive, the toner particles each include a toner mother particle and the external additive. The external additive is attached to a surface of the toner mother particle. The toner mother particles contain for example a binder resin as a main component. The toner mother particles containing the binder resin may contain an internal additive (for example, at least one of a colorant, a releasing agent, a charge control agent, and a magnetic powder) as necessary. Note that the external additive may be omitted in a situation in which such an additive is not necessary. In a situation in which the external additive is omitted, the toner mother particles are equivalent to the toner particles.

In order that the toner is suitable for image formation, the toner mother particles preferably have a volume median diameter ($D_{50}$) of at least 4 μm and no greater than 9 μm.

The toner particles may be toner particles including no shell layer or toner particles including shell layers (also referred to below as capsule toner particles). The toner mother particles of the capsule toner particles each include a toner core and a shell layer disposed on a surface of the toner core. The shell layer is substantially formed from a resin. Both heat-resistant preservability and low-temperature fixability of the toner can be achieved for example by covering toner cores that melt at low temperature with shell layers excellent in heat resistance. An additive may be dispersed in the resin forming the shell layer. The shell layer may entirely or partially cover the surface of the toner core. The shell layer may be substantially formed from a thermosetting resin or a thermoplastic resin, or may contain both a thermoplastic resin and a thermosetting resin.

The following describes components that may be contained in the toner particles.

(Binder Resin)

In order to improve low-temperature fixability of the toner, the binder resin contained in the toner mother particles preferably includes a thermoplastic resin. More preferably, the thermoplastic resin is included at a rate of at least 85% by mass relative to a total mass of the binder resin. Examples of thermoplastic resins include styrene-based resins, (meth) acrylic acid ester-based resins, olefin-based resins (specific examples include polyethylene resin and polypropylene resin), vinyl resins (specific examples include vinyl chloride resin, polyvinyl alcohol, vinyl ether resin, and N-vinyl resin), polyester resins, polyamide resins, and urethane resins. Copolymers of the resins listed above, that is, copolymers obtained through incorporation of a repeating unit into any of the resins listed above (specific examples include styrene-(meth)acrylic acid ester-based resins and styrene-butadiene-based resins) may be used as the binder resin.

The thermoplastic resin can be obtained through addition polymerization, copolymerization, or condensation polymerization of at least one thermoplastic monomer. Note that the thermoplastic monomer is a monomer that becomes a thermoplastic resin through homopolymerization (specific examples include (meth)acrylic acid ester-based monomer and styrene-based monomer) or a monomer that becomes a thermoplastic resin through condensation polymerization (for example, a combination of a polyhydric alcohol and a polybasic carboxylic acid that becomes a polyester resin through condensation polymerization.

The thermoplastic resin preferably has a glass transition point (Tg) of at least 30° C. and no greater than 55° C. in order to improve low-temperature fixability and inhibit aggregation of the toner particles. The thermoplastic resin preferably has a softening point (Tm) of no greater than 110° C., and more preferably no greater than 105° C. A softening point (Tm) of no greater than 110° C. can ensure that sufficient low-temperature fixability can be achieved even in high-speed fixing. Two or more of the thermoplastic resins listed above may be used as the thermoplastic resin in combination in order to adjust the above-mentioned properties of the thermoplastic resin.

In order to improve low-temperature fixability of the toner, the binder resin contained in the toner mother particles preferably includes a polyester resin. In order to increase strength and improve low-temperature fixability of the toner particles, the polyester resin preferably has a number average molecular weight (Mn) of at least 1,000 and no greater than 2,000. The polyester resin preferably has a molecular weight distribution (mass average molecular weight (Mw)/number average molecular weight (Mn)) of at least 9 and no greater than 21 for the same purpose as above.

The polyester resin can be obtained through condensation polymerization of at least one polyhydric alcohol and at least one polybasic carboxylic acid. Examples of alcohols that can be used for synthesis of the polyester resin include the following dihydric alcohols (specific examples include diols and bisphenols) and tri- or higher-hydric alcohols. Examples of carboxylic acids that can be used for synthesis of the polyester resin include the following dibasic carboxylic acids and tri- or higher-basic carboxylic acids. Note that a derivative of a polybasic carboxylic acid that can form an ester bond through condensation polymerization, such as an anhydride of the polybasic carboxylic acid or a halide of the polybasic carboxylic acid, may be used rather than the polybasic carboxylic acid.

Examples of preferable diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 2-pentene-1,5-diol, 1,6-hexanediol, 1,4-cyclohexanedimethanol, dipropylene glycol, 1,4-benzenediol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

The toner mother particles may contain a colorant. The colorant can be a known pigment or dye that matches the color of the toner. The amount of the colorant is preferably at least 1 part by mass and no greater than 20 parts by mass relative to 100 parts by mass of the binder resin in order that high-quality images are formed using the toner.

The toner mother particles may contain a black colorant. Carbon black can for example be used as a black colorant. Alternatively, a colorant can be used that has been adjusted to a black color using a yellow colorant, a magenta colorant, and a cyan colorant.

The toner mother particles may contain a non-black colorant. Examples of non-black colorants include yellow colorants, magenta colorants, and cyan colorants. At least one compound selected from the group consisting of condensed azo compounds, isoindolinone compounds, anthraquinone compounds, azo metal complexes, methine compounds, and arylamide compounds can be used as a yellow colorant. Examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used as a magenta colorant. Examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can be used as a cyan colorant. Examples of cyan colorants include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may contain a releasing agent. The releasing agent is for example used in order to improve offset resistance of the toner. The amount of the releasing agent is preferably at least 1 part by mass and no greater than 20 parts by mass relative to 100 parts by mass of the binder resin in order to improve offset resistance of the toner.

Examples of releasing agents that can be preferably used include: aliphatic hydrocarbon-based waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; ester waxes having a fatty acid ester as a main component, such as montanic acid ester wax and castor wax; and waxes in which a fatty acid ester has been partially or fully deoxidized (for example, deoxidized carnauba wax). A releasing agent may be used independently or two or more releasing agents may be used in combination in the present embodiment.

In a configuration in which the binder resin is a polyester resin, a preferable releasing agent is a carnauba wax, an ester wax, or a polyethylene wax. In a configuration in which the binder resin is a styrene-based resin, a preferable releasing agent is a paraffin wax or a Fischer-Tropsch wax. A compatibilizer may be added to the toner mother particles in order to improve compatibility between the binder resin and the releasing agent.

(Charge Control Agent)

The toner mother particles may contain a charge control agent. The charge control agent is for example used in order to improve charge stability or a charge rise characteristic of the toner. The charge rise characteristic of the toner is an indicator as to whether the toner can be charged to a specific charge level in a short period of time.

Anionic strength of the toner mother particles can be increased through the toner mother particles containing a negatively chargeable charge control agent. By contrast, cationic strength of the toner mother particles can be increased through the toner mother particles containing a positively chargeable charge control agent. However, when it is ensured that the toner has sufficient chargeability, the toner mother particles do not need to contain a charge control agent.

Examples of positively chargeable charge control agents include: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; metal salts of naphthenic acids; metal salts of higher organic carboxylic acids; alkoxylated amine; alkylamide; and quaternary ammonium salts such as benzyldecylhexylmethyl ammonium chloride, decyltrimethyl ammonium chloride, 2-(methacryloyloxy) ethyl trimethylammonium chloride, and dimethylaminopropyl acrylamide methyl chloride quaternary salt.

(Magnetic Powder)

The toner mother particles may contain a magnetic powder. Examples of materials of the magnetic powder include ferromagnetic metals (specific examples include iron, cobalt, and nickel), alloys of ferromagnetic metals, oxides of ferromagnetic metals (specific examples include ferrite, magnetite, and chromium dioxide), and materials subjected to ferromagnetization (specifically, thermal treatment). One magnetic powder may be used independently or two or more magnetic powders may be used in combination in the present embodiment.

(External Additive)

The external additive (powder of external additive particles) is for example used in order to improve fluidity or handleability of the toner. In order to improve fluidity or handleability of the toner, the amount of the external additive is preferably at least 0.1 parts by mass and no greater than 10 parts by mass relative to 100 parts by mass of the toner mother particles, and more preferably at least 0.3 parts by mass and no greater than 3 parts by mass.

Preferable external additive particles are inorganic particles. Examples of more preferable external additive particles include silica particles and particles of metal oxides (specific examples include alumina, titanium oxide, magnesium oxide, zinc oxide, strontium titanate, and barium titanate). One type of external additive particles may be used independently or two or more types of external additive particles may be used in combination in the present embodiment.

The external additive particles may be subjected to surface treatment. For example, in a situation in which silica particles are used as the external additive particles, surfaces of the silica particles may be made hydrophobic and/or positively chargeable with a surface treatment agent. Examples of surface treatment agents include coupling agents (specific examples include silane coupling agents, titanate coupling agents, and aluminate coupling agents), silazane compounds (specific examples include chain silazane compounds and cyclic silazane compounds), and silicone oils (specific examples include dimethyl silicone oils). A silane coupling agent or a silazane compound is particularly preferable as the surface treatment agent. Examples of preferable silane coupling agents include silane compounds (specific examples include methyltrimethoxysilane and aminosilane). Examples of preferable silazane compounds include hexamethyldisilazane (HMDS). When a surface of a silica base (untreated silica particles) is treated with a surface treatment agent, some or all of a large number of hydroxyl groups (—OH) on the surface of the silica base are replaced by functional groups derived from the surface treatment agent. As a result, silica particles having the functional groups derived from the surface treatment agent (specifically, functional groups that are more hydrophobic and/or more readily positively chargeable than the hydroxyl groups) on surfaces thereof are obtained.

(Toner Particle Production Method)

Examples of preferable methods for producing toner particles (where an external additive is used, toner mother particles) include a pulverization method and an aggregation method. The above methods can easily disperse an internal additive in the binder resin.

In an example of the pulverization method, the binder resin and one or more internal additives which are added as needed are mixed first. Subsequently, the resultant mixture is melt-kneaded using a melt-kneader (for example, a single-screw or twin-screw extruder). Next, the resultant melt-kneaded product is pulverized and classified. Through the above, toner particles (or toner mother particles) are produced.

In an example of the aggregation method, fine particles of the binder resin and fine particles of one or more internal additives which are added as needed are caused to aggregate in an aqueous medium including these fine particles to have desired particle diameters. As a result, aggregated particles containing the binder resin and the like are formed. Next, the resultant aggregated particles are heated for coalescence of components contained in the aggregated particles. Through the above, toner particles (or toner mother particles) having a desired particle diameter are produced.

In order that the toner particles include an external additive, external additive particles are attached to the surfaces of the toner mother particles by mixing and stirring the external additive particles and the toner mother particles produced by either of the above-described methods for example using a mixer. Thus, a plurality of toner particles including the external additive can be obtained.

[Lubricant Particles]

The following describes the lubricant particles included in the toner according to the first embodiment with reference to a drawing. FIG. 1 is a diagram illustrating an example of a sectional structure of a lubricant particle included in the toner according to the first embodiment.

As illustrated in FIG. 1, a lubricant particle 1 includes a core 2 and a coat layer 3 covering a surface of the core 2. In order to easily maintain charge stability, the coat layer 3 preferably covers the entirety of the surface of the core 2.

(Cores)

The cores 2 contain stearic acid, palmitic acid, or a combination thereof (specific lubricant), each of which functions as a lubricant. In order to further inhibit impairment in cleaning ability of the cleaning member, the cores 2 preferably contain the specific lubricant as a main component. The cores 2 more preferably contain the specific lubricant preferably at a rate of at least 80% by mass relative to a total mass of all components contained in the cores 2, further preferably at least 90% by mass, and particularly preferably 100% by mass. For the same purpose as above, the cores 2 preferably contain stearic acid. Note that examples of components that may be contained in the cores 2 other than the specific lubricant include a lubricant other than the specific lubricant and a residual solvent in an organic phase used in a later-described method for producing the lubricant particles 1.

(Coat Layers)

Each of the coat layers 3 includes a first coat layer 4 covering the surface of the core 2 and a second coat layer 5 covering a surface of the first coat layer 4. The coat layer 3 has a thickness (specifically, a total thickness of the first and second coat layers 4 and 5) of at least 10 nm and no greater than 50 nm. In order to easily maintain charge stability, the coat layer 3 preferably has a thickness of at least 15 nm, and more preferably at least 20 nm. By contrast, in order to further inhibit impairment in cleaning ability of the cleaning member, the coat layer 3 preferably has a thickness of no greater than 40 nm, and more preferably no greater than 30 nm.

The first coat layers 4 preferably contain a polyamide resin, more preferably contain the polyamide resin as a main component, further preferably contain the polyamide resin at a rate of at least 90% by mass relative to a total mass of all components contained in the first coat layers 4, and particularly preferably contain the polyamide resin at a rate of 100% by mass. In a situation in which a polyamide resin is used as a material of the first coat layers 4, polyamide resin films can be formed on the surfaces of the cores 2 through interfacial polymerization. As such, the first coat layers 4 (polyamide resin films) covering the surfaces of the cores 2 can be easily formed.

In order to further inhibit impairment in cleaning ability of the cleaning member while easily maintaining charge stability, a constitutional material of the second coat layers 5 is preferably a polymer of a vinyl compound or a polyurea resin, and more preferably the polymer of the vinyl compound. For the same purpose as above, the second coat layers 5 preferably contain the polymer of the vinyl compound or the polyurea resin as a main component, further preferably contain the polymer of the vinyl compound or the polyurea resin at a rate of at least 90% by mass relative to a total mass of all constitutional materials of the second coat layers 5, and particularly preferably contain the polymer of the vinyl compound or the polyurea resin at a rate of 100% by mass. Note that the vinyl compound is a compound having a vinyl group ($CH_2$═CH—) or a compound having a substituted vinyl group in which hydrogen is replaced (specific examples include ethylene, propylene, butadiene, vinyl chloride, (meth)acrylic acid, methyl (meth)acrylate, (meth)acrylonitrile, and styrene). The vinyl compound can become a macromolecule (resin) through addition polymerization by carbon-to-carbon double bonding (C═C) for example in the vinyl group.

Examples of vinyl compounds include: styrene-based compounds such as styrene, o-methylstyrene, m-methylstyrene, p-methylstyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene; (meth)acrylic acid ester-based compounds such as methyl (meth)acrylate, ethyl (meth)acrylate, n-propyl (meth)acrylate, iso-propyl (meth)acrylate, n-butyl (meth)acrylate, isobutyl (meth)acrylate, t-butyl (meth)acrylate, n-octyl (meth)acrylate, 2-ethylhexyl (meth)acrylate, stearyl (meth)acrylate, lauryl (meth)acrylate, and phenyl (meth)acrylate; vinyl ester-based compounds such as vinyl acetate and vinyl propionate; vinyl ether-based compounds such as vinyl methyl ether and vinyl ethyl ether; vinyl ketone-based compounds such as vinyl methyl ketone, vinyl ethyl ketone, and vinyl hexyl ketone; (meth)acrylic acid; (meth)acrylonitrile; aliphatic diene-based compounds such as isoprene, 1,3-butadiene, 3-methyl-1,2-butadiene, 2,3-dimethyl-1,3-butadiene, pentadiene, hexadiene, and octadiene; alicyclic diene-based compounds such as cyclopentadiene, cyclohexadiene, and cyclooctadiene; aromatic divinyl-based compounds such as divinylbenzene, divinyltoluene, divinylxylene, divinyl biphenyl, and divinylnaphthalene; and di(meth)acrylic acid-based compounds such as ethylene di(meth)acrylate, ethylene glycol di(meth)acrylate, and 1,6-hexylene di(meth)acrylate. One of the vinyl compounds listed above may be polymerized independently, or two or more of the vinyl compounds listed above may be copolymerized.

In order to easily maintain charge stability through an increase in strength of the second coat layers 5, it is preferable to form the second coat layers 5 from a polymer of monomer components including a vinyl compound having a plurality of carbon-to-carbon double bonds (C=C). For the same purpose as above, the vinyl compound having a plurality of carbon-to-carbon double bonds (C=C) is preferably any one of the above-listed aliphatic diene-based compounds, alicyclic diene-based compounds, aromatic divinyl-based compounds, and di(meth)acrylic acid-based compounds, and more preferably an aromatic divinyl-based compound or a di(meth)acrylic acid-based compound, further preferably divinylbenzene or ethylene glycol di(meth) acrylate, and particularly preferably divinylbenzene. In order to further easily maintain charge stability, the second coat layers 5 are preferably formed from a polymer of monomer components including divinylbenzene.

In a situation in which a polyamide resin is used as a constitutional material of the first coat layers 4 and a polymer of a vinyl compound or a polyurea resin is used as a constitutional material of the second coat layers 5, a thickness ratio (second coat layer 5/first coat layer 4) of the second coat layer 5 to the first coat layer 4 is preferably at least 1 and no greater than 100, and more preferably at least 5 and no greater than 50. When the thickness ratio (second coat layer 5/first coat layer 4) is in the above range, impairment in cleaning ability of the cleaning member can be further inhibited while charge stability can be easily maintained. Note that the thickness ratio (second coat layer 5/first coat layer 4) can be adjusted for example by changing a polymerization time in formation of the second coat layers 5. Use of either a polyurea resin or a polymer of a vinyl compound can more easily adjust the thickness of coat layers 3 than use of a polyamide resin.

The lubricant particles 1 preferably have a number average particle diameter of at least 0.1 μm in order to easily maintain charge stability, more preferably at least 0.5 μm, and further preferably at least 1.0 μm. Furthermore, the lubricant particles 1 preferably have a number average particle diameter of no greater than 5.0 μm in order to further inhibit impairment in cleaning ability of the cleaning member. Note that the number average particle diameter of the lubricant particles 1 can be adjusted in preparation of a dispersion of the specific lubricant for formation of the cores 2 for example by changing a concentration of the specific lubricant in the dispersion (emulsion) and stirring speed of the dispersion.

(Method for Producing Lubricant Particles)

The following describes an example of methods for producing the lubricant particles 1. The below-described example method is a method for producing the lubricant particles 1 each having the first coat layer 4 of which constitutional material is a polyamide resin.

First, a water phase in which a dispersion stabilizer such as gum arabic is dissolved and an organic phase in which the specific lubricant and polycarboxylic acid chloride are dissolved are prepared. Subsequently, the water phase and the organic phase are mixed and stirred together to prepare an emulsion obtained through dispersion of oil drops in an aqueous solution (also referred to below as an O/W emulsion). Next, an alkaline aqueous solution containing an amine-based polymerizable compound such as ethylene diamine is added to the O/W emulsion. Then, an interfacial polymerization reaction is caused around the oil drops containing the specific lubricant to cover the surfaces of the cores 2 containing the specific lubricant with polyamide resin films (first coat layers 4). An O/W emulsion containing a polymerizable compound (specific examples include a vinyl compound and an isocyanate-based polymerizable compound) is then added to a reaction liquid after the interfacial polymerization reaction to cause polymerization of the polymerizable compound on the surfaces of the polyamide resin films (first coat layers 4). Through polymerization, a plurality of lubricant particles 1 are obtained that each include the first coat layer 4 having a surface covered with a film constituted by a polymer of the polymerizable compound (second coat layer 5). Note that in a situation in which an isocyanate-based polymerizable compound such as 2,4-tolylene diisocyanate is used as the polymerizable compound added to the reaction liquid after the interfacial polymerization reaction, polyurea resin films are formed through a polyaddition reaction between the amine-based polymerizable compound and the isocyanate-based polymerizable compound.

[Toner Production Method]

The following describes an example of methods for producing the toner according to the first embodiment. First, a plurality of toner particles (or toner mother particles) produced by the above-described method and a plurality of lubricant particles produced by the above-described method are prepared. Next, materials including at least the toner particles (or toner mother particles) and the lubricant particles are mixed and stirred using a mixer to obtain the toner. Note that in a situation using an external additive, the toner particles can be obtained in a manner that the external additive is further added and mixed in mixing using the mixer to attach the external additive to surfaces of the toner mother particles.

The toner according to the first embodiment has been described so far. However, the toner of the present disclosure is not limited to the above embodiment. For example, the above embodiment describes an example in which the coat layers of the lubricant particles each include the first coat layer and the second coat layer. However, the lubricant particles of the toner of the present disclosure may each have a single-layer coat layer.

Second Embodiment: Image Forming Apparatus

Figure 2:
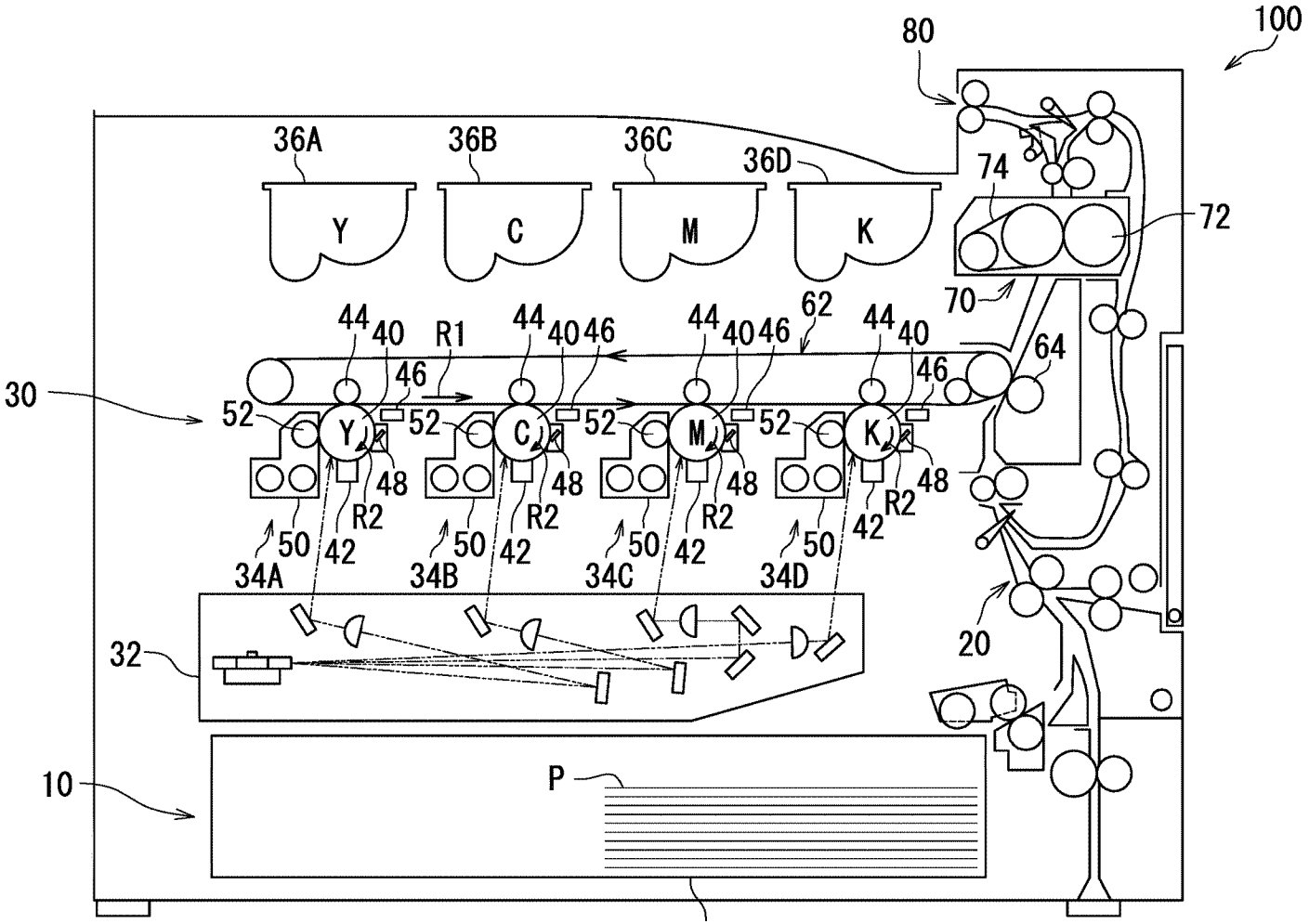
FIG. 2 is a schematic diagram illustrating an example of a configuration of an image forming apparatus according to a second embodiment of the present disclosure.

The following describes an image forming apparatus according to a second embodiment of the present disclosure. FIG. 2 is a diagram illustrating a configuration of an image forming apparatus 100 that is an example of the image forming apparatus according to the second embodiment. The image forming apparatus 100 is a printer that forms an image on a sheet P that is a recording medium. The image forming apparatus 100 includes a feeding section 10, a conveyance section 20, an image forming section 30, and an ejection section 80.

The feeding section 10 includes a cassette 11 that accommodates a plurality of sheets P. The sheets P are for example sheets of paper or synthetic resin-made sheets. The feeding section 10 feeds a sheet P to the conveyance section 20. The conveyance section 20 conveys the sheet P to the image forming section 30. The image forming section 30 forms an image on the sheet P. The conveyance section 20 conveys the sheet P with the image formed thereon to the ejection section 80. The ejection section 80 ejects the sheet P out of the image forming apparatus 100.

The image forming section 30 includes a light exposure unit 32, a first toner image generating unit 34A, a second toner image generating unit 34B, a third toner image generating unit 34C, a fourth toner image generating unit 34D, a first toner cartridge 36A, a second toner cartridge 36B, a third toner cartridge 36C, a fourth toner cartridge 36D, an intermediate transfer belt 62, a secondary transfer roller 64, and a fixing device 70. The image forming apparatus 100 herein is a tandem image forming apparatus in which the first, second, third, and fourth toner image generating units 34A, 34B, 34C, and 34D are arranged linearly.

Note that the first to fourth toner image generating units 34A to 34D may be referred simply to as toner image generating units 34A to 34D in order to avoid redundancy in the following description. Similarly, the first to fourth toner cartridges 36A to 36D may be referred simply to as toner cartridges 36A to 36D.

The light exposure unit 32 irradiates the toner image generating units 34A to 34D with light based on image data to form electrostatic latent images in the respective toner image generating units 34A to 34D.

The toner image generating unit 34A forms a yellow toner image from a corresponding one of the electrostatic latent images. The toner image generating unit 34B forms a cyan toner image from a corresponding one of the electrostatic latent images. The toner image generating unit 34C forms a magenta toner image from a corresponding one of the electrostatic latent images. The toner image generating unit 34D forms a black toner image from a corresponding one of the electrostatic latent images.

The toner cartridge 36A contains a toner for yellow toner image formation. The toner cartridge 36B contains a toner for cyan toner image formation. The toner cartridge 36C contains a toner for magenta toner image formation. The toner cartridge 36D contains a toner for black toner image formation. The toners contained in the respective toner cartridges 36A to 36D each are the above-described toner according to the first embodiment.

The intermediate transfer belt 62 circulates in a direction of an arrow R1. The intermediate transfer belt 62 has an outer surface to which the toner images in four colors are sequentially transferred from the toner image generating units 34A to 34D (primary transfer). The secondary transfer roller 64 transfers the toner images formed on the outer surface of the intermediate transfer belt 62 to the sheet P (secondary transfer). The fixing device 70 applies heat and pressure to the sheet P to fix the toner images to the sheet P.

Each of the toner image generating units 34A to 34D includes a photosensitive drum 40 (image bearing member), a charger 42, a development device 50, a primary transfer roller 44, a static eliminator 46, and a cleaning blade 48. In each of the toner image generating units 34A to 34D, the charger 42, the development device 50, the primary transfer roller 44, the static eliminator 46, and the cleaning blade 48 are disposed around a circumferential surface of the photosensitive drum 40 in the stated order.

The photosensitive drums 40 of the toner image generating units 34A to 34D are disposed along the intermediate transfer belt 62 in the direction of the arrow R1, which is a circulation direction of the intermediate transfer belt 62, to be in contact with the outer surface of the intermediate transfer belt 62. The primary transfer rollers 44 are provided correspondingly to the respective photosensitive drums 40, and disposed opposite to the respective photosensitive drums 40 with the intermediate transfer belt 62 therebetween.

The photosensitive drums 40 rotate in directions of respective arrows R2. The chargers 42 each charge the circumferential surface of a corresponding one of the photosensitive drums 40. The light exposure unit 32 irradiates portions of the circumferential surfaces of the photosensitive drums 40 with light to form electrostatic latent images.

No limitation is placed on the photosensitive drums 40, and an amorphous silicon photosensitive member or a photosensitive member including a photosensitive layer containing an organic photoconductor can be used as each of the photosensitive drums 40, for example.

The development devices 50 each contain for example a two-component developer including the toner and a carrier. Each development device 50 of the toner image generating units 34A to 34D is connected to a corresponding one of the toner cartridges 36A to 36D. Each of the toners contained in the development devices 50 is supplied from a corresponding one of the toner cartridges 36A to 36D. Note that the carrier may be contained only in the development devices 50 or contained in both the toner cartridges 36A to 36D and the development devices 50. In the latter case, the toner cartridges 36A to 36D may each supply both the toner and the carrier to a corresponding one of the development devices 50.

Each of the development devices 50 includes a development roller 52. The development roller 52 carries for example the two-component developer including the toner and the carrier. In the above configuration, the development roller 52 functions as a developer bearing member. The development roller 52 carrying the developer supplies the toner in the developer to the photosensitive drum 40. The development device 50 attaches the toner to the electrostatic latent image on the photosensitive drum 40 to develop the electrostatic latent image into a toner image on the circumferential surface of the photosensitive drum 40.

Each of the primary transfer rollers 44 (transfer device) transfers the toner image carried by a corresponding one of the photosensitive drums 40 to the outer surface of the intermediate transfer belt 62 (transfer target). Each of the static eliminators 46 performs static elimination on the circumferential surface of a corresponding one of the photosensitive drums 40 after transfer of the toner image to the intermediate transfer belt 62.

The cleaning blades 48 are for example rubber-made blades. Each of the cleaning blades 48 is in pressure contact with the surface of a corresponding one of the photosensitive drums 40 after transfer of the toner images to the intermediate transfer belt 62. The cleaning blade 48 can remove a residue (part of the toner) on the surface of the photosensitive drum 40, which is rotating in a direction of a corresponding one of the arrows R2, during the cleaning blade 48 being in pressure contact with the surface of the photosensitive drum 40. Friction force between the cleaning blade 48 and the surface of the photosensitive drum 40 breaks at least some of the coat layers of the lubricant particles included in the residue in removal of the residue on the surface of the photosensitive drum 40 by the cleaning blade 48. Through breakage of the coat layers, the specific lubricant contained in the lubricant particles is applied onto the surface of the photosensitive drum 40. This reduces friction force between the cleaning blade 48 and the surface of the photosensitive drum 40. As a result, warping of the cleaning blade 48 can be inhibited to inhibit impairment in cleaning ability of the cleaning blade 48. Thus, occurrence of an image defect caused due to presence of a residue can be prevented in the image forming apparatus 100.

In a situation in which an amorphous silicon photosensitive member is used that includes a photosensitive layer containing amorphous silicon at a surface layer portion thereof, a cleaning member usually tends to warp because the photosensitive layer of the amorphous silicon photosensitive member is hard. However, warping of the cleaning blades 48 can be inhibited even when such amorphous silicon photosensitive members are used in the image forming apparatus 100 because toner images are each formed with a developer including the toner according to the first embodiment.

The toner images transferred to the outer surface of the intermediate transfer belt 62 are transferred to the sheet P by the secondary transfer roller 64. The sheet P to which the toner images have been transferred is conveyed to the fixing device 70 by the conveyance section 20. The fixing device 70 includes a fixing belt 74 and a pressure roller 72 that applies pressure to the toner images having been transferred to the sheet P. The pressure roller 72 can be a roller for fixing device use including a surface layer for example made from fluororesin. The sheet P conveyed to the fixing device 70 receives heat and pressure between the pressure roller 72 and the fixing belt 74. Through the above, the toner images (image) are fixed to the sheet P. Thereafter, the sheet P is ejected out of the image forming apparatus 100 from the ejection section 80. Through the above, the image forming apparatus 100 forms the image on the sheet P.

An example of the image forming apparatus according to the second embodiment has been described so far. However, the image forming apparatus according to the second embodiment is not limited to the above-described image forming apparatus 100. For example, the image forming apparatus according to the second embodiment may be a monochrome image forming apparatus. In the above configuration, it is only required for example that the image forming apparatus include one toner image generating unit and one toner cartridge. Furthermore, the image forming apparatus according to the second embodiment may employ a direct transfer process. In a configuration in which the image forming apparatus according to the second embodiment employs the direct transfer process, the transfer device directly transfers the toner images on the photosensitive drums (image bearing members) to a recording medium.

Third Embodiment: Image Forming Method

An image forming method according to a third embodiment is a method for forming an image for example using the above-described image forming apparatus according to the second embodiment. The following describes a preferable example of image forming methods according to the third embodiment.

The preferable example of image forming methods includes developing, transferring, and removing a remaining substance (residue). In the developing, an electrostatic latent image formed on a surface of an image bearing member (for example, each photosensitive drum 40 illustrated in FIG. 2) is developed into a toner image with a developer containing the above-described toner according to the first embodiment. In the transferring, the toner image is transferred to a transfer target (for example, the intermediate transfer belt 62 illustrated in FIG. 2). In the removing a residue, a residue on the surface of the image bearing member is removed by a cleaning member (for example, each cleaning blade 48 illustrated in FIG. 2) that is in pressure contact with the surface of the image bearing member after the transferring.

The developer containing the above-described toner according to the first embodiment is used in the preferable example of image forming methods according to the third embodiment. Thus, impairment in cleaning ability of the cleaning member can be inhibited for the same reason as in the case of the image forming apparatus 100. Therefore, occurrence of an image defect caused due to presence of a residue can be prevented when the above-described image forming method is employed.

EXAMPLES

The following describes examples of the present disclosure. A method for measuring thickness of coat layers of lubricant particles will be described first.

<Method for Measuring Thickness of Coat Layers of Lubricant Particles>

With respect to respective types of lubricant particles obtained by the later-described methods, the lubricant particles were dispersed in a cold-setting epoxy resin and the epoxy resin including the lubricant particles was hardened for 2 days at an atmospheric temperature of 40° C. to obtain a hardened material. The resultant hardened material was dyed with osmium tetroxide, and sliced using an ultramicrotome ("EM UC6", product of Leica Microsystems Inc.) including a diamond knife to obtain a thin sample piece. Subsequently, a section of the obtained thin sample piece was captured at a magnification of 10,000× using a transmission electron microscope (TEM, "H-7100FA", product of Hitachi High-Technologies Corporation).

The captured TEM image was analyzed using image analysis software ("WinROOF", product of Mitani Corporation) to determine a thickness of coat layers. Specifically, two straight lines that perpendicularly intersect at approximately the center of a cross-section of a lubricant particle were drawn and lengths of four segments where the two straight lines intersected the coat layer were measured. An arithmetic mean value of the measured four lengths was determined to be the thickness of the coat layer of the lubricant particle. Thicknesses of the coat layers of 20 lubricant particles included in a measurement target were measured, and an arithmetic mean of the obtained 20 measurement values was determined to be an evaluation value (thickness of the coat layers) of the measurement target (lubricant particles).

<Synthesis of Binder Resin>

A four-necked flask (capacity: 5 L) was charged with 1,500 g of terephthalic acid, 1,500 g of isophthalic acid, 1,200 g of a bisphenol A ethylene oxide adduct (average addition number of moles of ethylene oxide: 2 mol), and 800 g of ethylene glycol. Subsequently, the internal atmosphere of the flask was changed to a nitrogen atmosphere and the internal temperature of the flask was increased up to 250° C. while the flask contents were stirred. Thereafter, a reaction was caused for 4 hours under conditions of a standard pressure and a temperature of 250° C. Next, 0.8 g of antimony trioxide, 0.5 g of triphenyl phosphate, and 0.1 g of tetrabutyl titanate were added into the flask. The internal pressure of the flask was reduced to 0.04 kPa, and the internal temperature of the flask was increased up to 280° C. Then, a reaction was caused for 6 hours. Next, 30.0 g of trimellitic acid (cross-linking agent) was further added into the flask. The internal pressure of the flask was returned to the standard pressure, and the internal temperature of the flask was reduced to 230° C. Then, a reaction was caused for 1 hour. After the reaction, a reaction product was taken out from the flask and cooled to obtain a polyester resin P1 as a binder resin. The resultant polyester resin P1 had a glass transition point (Tg) of 53.8° C., a softening point (Tm) of 100.5° C., a number average molecular weight (Mn) of 1,460, a molecular weight distribution (Mw/Mn) of 12.7, an acid value of 16.8 mgKOH/g, and a hydroxyl value of 22.8 mgKOH/g.

<Preparation of Lubricant Particles>

[Preparation of Lubricant Particles A]

A water phase (continuous phase) was prepared by dissolving 2 parts by mass of gum arabic as a dispersion stabilizer in 100 parts by mass of distilled water. On the other hand, an organic phase (dispersed phase) was prepared by dissolving 94 parts by mass of stearic acid, 2 parts by mass of sebacoyl chloride, and 4 parts by mass of trimesoyl chloride in 100 parts by mass of toluene. The water phase and the organic phase prepared as above were loaded into a homogenizer ("ULTRASONIC HOMOGENIZER 600W", product of NIPPON SEIKI CO., LTD.), and stirred at a rotational speed of 5,000 rpm for 2 minutes at an atmospheric temperature of 70° C. to prepare an O/W emulsion for first coat layer formation. Then, an aqueous solution of 8 mol/L of sodium hydroxide (0.5 parts by mass) containing 8% by mass of ethylene diamine was dripped into the resultant O/W emulsion over 30 minutes. Thereafter, 10-minute stirring at a rotational speed of 1,000 rpm was performed thereon at an atmospheric temperature of 40° C. to cause an interfacial polymerization reaction around oil drops containing stearic acid. Thus, polyamide resin films (first coat layers) covering the surfaces of cores containing stearic acid were formed.

Subsequently, the resultant reaction liquid was moved to a round-bottomed polymerization reaction apparatus (four-necked flask). Further, an O/W emulsion E1 prepared by the below-described preparation method was added thereto at a rate of 40% by mass relative to a total mass of the reaction liquid and the O/W emulsion E1 at an atmospheric temperature of 10° C. under stirring at a rotational speed of 300 rpm to attach the O/W emulsion E1 to the surfaces of the polyamide resin films (first coat layers). Thereafter, the resultant reaction system was increased in temperature up to 40° C. and stirred at a rotational speed of 300 rpm for 5 minutes to cause a radical polymerization reaction on the surfaces of the polyamide resin firms (first coat layers). After the reaction, the resultant suspension was cooled and subjected to washing and dehydration. Through the above, a number of lubricant particles A were obtained each of which included a core containing stearic acid and covered with a coat layer. Each of the coat layers of the lubricant particles A included the first coat layer (polyamide resin film) covering the surface of the core and the second coat layer (film constituted by a polymer of a vinyl compound) covering the surface of the first coat layer. The coat layers of the lubricant particles A had a thickness (total thickness of the first and second coat layers) of 10 nm. The lubricant particles A had a number average particle diameter of 1.0 μm. Note that a number average value of equivalent circle diameters of 100 lubricant particles A (primary particles) was determined to be the number average particle diameter of the lubricant particles A. The same is applied to the respective types of lubricant particles for which preparation methods will be described below.

(Preparation of O/W Emulsion E1)

An organic phase was prepared by adding 30 parts by mass of divinylbenzene, 60 parts by mass of 2,2'-azobis(4-methoxy-2,4-dimethylvaleronitrile), and 10 parts by mass of hexaglycerin ricinoleic acid ester to 100 parts by mass of toluene. A water phase was also prepared by adding 0.4 parts by mass of sodium chloride to 100 parts by mass of distilled water. The water phase and the organic phase prepared as above were loaded into a homogenizer ("ULTRASONIC HOMOGENIZER 600W", product of NIPPON SEIKI CO., LTD.), and stirred at a rotational speed of 3,000 rpm for 1 minute at an atmospheric temperature of 10° C. to prepare an O/W emulsion E1.

[Preparation of Lubricant Particles B]

A number of lubricant particles B each including a core containing stearic acid and covered with a coat layer were obtained by the same preparation method as for the lubricant particles A in all aspects other than that the stirring time of the reaction system at a rotational speed of 300 rpm after the addition of the O/W emulsion E1 and the increase in temperature of the reaction system to 40° C. was changed to 10 minutes. Each of the coat layers of the lubricant particles B included the first coat layer (polyamide resin film) covering the surface of the core and the second coat layer (film constituted by a polymer of a vinyl compound) covering the surface of the first coat layer. The coat layers of the lubricant particles B had a thickness (total thickness of the first and second coat layers) of 20 nm. The lubricant particles B had a number average particle diameter of 1.1 μm.

[Preparation of Lubricant Particles C]

A number of lubricant particles C each including a core containing stearic acid and covered with a coat layer were obtained by the same preparation method as for the lubricant particles A in all aspects other than that the stirring time of the reaction system at a rotational speed of 300 rpm after the addition of the O/W emulsion E1 and the increase in temperature of the reaction system to 40° C. was changed to 30 minutes. Each of the coat layers of the lubricant particles C included the first coat layer (polyamide resin film) covering the surface of the core and the second coat layer (film constituted by a polymer of a vinyl compound) covering the surface of the first coat layer. The coat layers of the lubricant particles C had a thickness (total thickness of the first and second coat layers) of 50 nm. The lubricant particles C had a number average particle diameter of 1.2 μm.

[Preparation of Lubricant Particles D]

A number of lubricant particles D each including a core containing stearic acid and covered with a coat layer were obtained by the same preparation method as for the lubricant particles A in all aspects other than that: the organic phase loaded into the homogenizer for forming the first coat layers was changed to an organic phase obtained by dissolving 94 parts by mass of stearic acid, 2 parts by mass of sebacoyl chloride, and 4 parts by mass of trimesoyl chloride in 60 parts by mass of toluene; and the rotational speed of the homogenizer was changed to 10,000 rpm in preparation of the O/W emulsion for first coat layer formation. Each of the coat layers of the lubricant particles D included the first coat layer (polyamide resin film) covering the surface of the core and the second coat layer (film constituted by a polymer of a vinyl compound) covering the surface of the first coat layer. The coat layers of the lubricant particles D had a thickness (total thickness of the first and second coat layers) of 10 nm. The lubricant particles D had a number average particle diameter of 0.1 μm.

[Preparation of Lubricant Particles E]

A number of lubricant particles E each including a core containing stearic acid and covered with a coat layer were obtained by the same preparation method as for the lubricant particles A in all aspects other than that the rotational speed of the homogenizer was changed to 500 rpm in preparation of the O/W emulsion for first coat layer formation. Each of the coat layers of the lubricant particles E included the first coat layer (polyamide resin film) covering the surface of the core and the second coat layer (film constituted by a polymer of a vinyl compound) covering the surface of the first coat layer. The coat layers of the lubricant particles E had a thickness (total thickness of the first and second coat layers) of 10 nm. The lubricant particles E had a number average particle diameter of 5.0 μm.

[Preparation of Lubricant Particles F]

A number of lubricant particles F each including a core containing palmitic acid and covered with a coat layer were obtained by the same preparation method as for the lubricant particles A in all aspects other than that palmitic acid was used in place of stearic acid as a lubricant component in the organic phase loaded in the homogenizer in formation of the first coat layers. Each of the coat layers of the lubricant particles F included the first coat layer (polyamide resin film) covering the surface of the core and the second coat layer (film constituted by a polymer of a vinyl compound) covering the surface of the first coat layer. The coat layers of the lubricant particles F had a thickness (total thickness of the first and second coat layers) of 10 nm. The lubricant particles F had a number average particle diameter of 1.0 μm.

[Preparation of Lubricant Particles G]

A number of lubricant particles G each including a core containing stearic acid and covered with a coat layer were obtained by the same preparation method as for the lubricant particles A in all aspects other than the following changes. Each of the coat layers of the lubricant particles G included the first coat layer (polyamide resin film) covering the surface of the core and the second coat layer (film constituted by a polymer of a vinyl compound) covering the surface of the first coat layer. The coat layers of the lubricant particles G had a thickness (total thickness of the first and second coat layers) of 50 nm. The lubricant particles G had a number average particle diameter of 0.1 μm.

(Changes)

The organic layer loaded into the homogenizer in formation of the first coat layers was changed to an organic phase obtained by dissolving 94 parts by mass of stearic acid, 2 parts by mass of sebacoyl chloride, and 4 parts by mass of trimesoyl chloride in 60 parts by mass of toluene. In preparation of the O/W emulsion for first coat layer formation, the rotational speed of the homogenizer was changed to 10,000 rpm. The stirring time of the reaction system at a rotational speed of 300 rpm after the addition of the O/W emulsion E1 and the increase in temperature of the reaction system to 40° C. was changed to 30 minutes.

[Preparation of Lubricant Particles H]

A number of lubricant particles H each including a core containing stearic acid and covered with a coat layer were obtained by the same preparation method as for the lubricant particles A in all aspects other than that an O/W emulsion E2 prepared by the below-described preparation method was used in place of the O/W emulsion E1. Each of the coat layers of the lubricant particles H included the first coat layer (polyamide resin film) covering the surface of the core and the second coat layer (film constituted by a polymer of a vinyl compound) covering the surface of the first coat layer. The coat layers of the lubricant particles H had a thickness (total thickness of the first and second coat layers) of 10 nm. The lubricant particles H had a number average particle diameter of 1.0 μm.

(Preparation of O/W Emulsion E2)

An organic phase was prepared by adding 30 parts by mass of divinylbenzene, 10 parts by mass of ethylene glycol dimethacrylate, 60 parts by mass of 2,2'-azobis(4-methoxy-2,4-dimethylvaleronitrile), and 10 parts by mass of hexaglycerin ricinoleic acid ester to 100 parts by mass of toluene. A water phase was prepared by adding 0.4 parts by mass of sodium chloride to 100 parts by mass of distilled water. The water phase and the organic phase prepared as above were loaded into a homogenizer ("ULTRASONIC HOMOGENIZER 600W", product of NIPPON SEIKI CO., LTD.), and stirred at a rotational speed of 3,000 rpm for 1 minute at an atmospheric temperature of 10° C. to prepare the O/W emulsion E2.

[Preparation of Lubricant Particles I]

A number of lubricant particles I each including a core containing stearic acid and covered with a coat layer were obtained by the same preparation method as for the lubricant particles A in all aspects other than that: an O/W emulsion E3 prepared by the below-described preparation method was used in place of the O/W emulsion E1; and the stirring time of the reaction system at a rotational speed of 300 rpm after the addition of the O/W emulsion E3 and the increase in temperature of the reaction system to 40° C. was changed to 10 minutes. Each of the coat layers of the lubricant particles I included the first coat layer (polyamide resin film) covering the surface of the core and the second coat layer (polyurea resin film) covering the surface of the first coat layer. The coat layers of the lubricant particles I had a thickness (total thickness of the first and second coat layers) of 10 nm. The lubricant particles I had a number average particle diameter of 1.0 μm.

(Preparation of O/W Emulsion E3)

An organic phase was prepared by adding 60 parts by mass of 2,4-tolylene diisocyanate, 20 parts by mass of sorbitan monooleate, and 20 parts by mass of phenyl isocyanate to 100 parts by mass of toluene. A water phase was prepared by adding 2 parts by mass of gum arabic to 100 parts by mass of distilled water. The water phase and the organic phase prepared as above were loaded into a homogenizer ("ULTRASONIC HOMOGENIZER 600W", product of NIPPON SEIKI CO., LTD.), and stirred at a rotational speed of 3,000 rpm for 1 minute at an atmospheric temperature of 10° C. to prepare the O/W emulsion E3.

[Preparation of Lubricant Particles J]

A number of lubricant particles J each including a core containing stearic acid and covered with a coat layer were obtained by the same preparation method as for the lubricant particles A in all aspects other than that the stirring time of the reaction system at a rotational speed of 300 rpm after the addition of the O/W emulsion E1 and the increase in temperature of the reaction system to 40° C. was changed to 60 minutes. Each of the coat layers of the lubricant particles J included the first coat layer (polyamide resin film) covering the surface of the core and the second coat layer (film constituted by a polymer of a vinyl compound) covering the surface of the first coat layer. The coat layers of the lubricant particles J had a thickness (total thickness of the first and second coat layers) of 100 nm. The lubricant particles J had a number average particle diameter of 1.4 μm.

[Preparation of Lubricant Particles K]

A number of lubricant particles K each including a core containing stearic acid and covered with a coat layer were obtained by the same preparation method as for the lubricant particles A in all aspects other than that the stirring time of the reaction system at a rotational speed of 300 rpm after the addition of the O/W emulsion E1 and the increase in temperature of the reaction system to 40° C. was changed to 1 minute. Each of the coat layers of the lubricant particles K included the first coat layer (polyamide resin film) covering the surface of the core and the second coat layer (film constituted by a polymer of a vinyl compound) covering the surface of the first coat layer. The coat layers of the lubricant particles K had a thickness (total thickness of the first and second coat layers) of 5 nm. The lubricant particles K had a number average particle diameter of 1.0 μm.

[Preparation of Lubricant Particles L]

A number of lubricant particles L each including a core containing stearic acid and covered with a coat layer were obtained by the same preparation method as for the lubricant particles A in all aspects other than the following changes. Each of the coat layers of the lubricant particles L included the first coat layer (polyamide resin film) covering the surface of the core and the second coat layer (film constituted by a polymer of a vinyl compound) covering the surface of the first coat layer. The coat layers of the lubricant particles L had a thickness (total thickness of the first and second coat layers) of 60 nm. The lubricant particles L had a number average particle diameter of 0.1 μm.

(Changes)

The organic phase loaded in the homogenizer in formation of the first coat layers was changed to an organic phase obtained by dissolving 94 parts by mass of stearic acid, 2 parts by mass of sebacoyl chloride, and 4 parts by mass of trimesoyl chloride in 60 parts by mass of toluene. The rotational speed of the homogenizer in preparation of the O/W emulsion for first coat layer formation was changed to 10,000 rpm. The stirring time at a rotational speed of 300 rpm after the addition of the O/W emulsion E1 and the increase in temperature of the reaction system to 40° C. was changed to 40 minutes.

[Preparation of Lubricant Particles M]

A water phase (continuous phase) was prepared by dissolving 2 parts by mass of gum arabic as a dispersion stabilizer in 100 parts by mass of distilled water. An organic phase (dispersed phase) was also prepared by dissolving 94 parts by mass of stearic acid in 60 parts by mass of toluene. The water phase and the organic phase prepared as above were loaded into a homogenizer ("ULTRASONIC HOMOGENIZER 600W", product of NIPPON SEIKI CO., LTD.), and stirred at a rotational speed of 10,000 rpm for 2 minutes at an atmospheric temperature of 70° C. to prepare an O/W emulsion. The resultant O/W emulsion was cooled, and subjected to washing and dehydration. Through the above, lubricant particles M (stearic acid particles) having a number average particle diameter of 1.0 μm were obtained.

<Preparation of Toner Mother Particles>

First, 90 parts by mass of the polyester resin P1, 5 parts by mass of a carbon black ("MA-100", product of Mitsubishi Chemical Corporation), and 5 parts by mass of a carnauba wax ("SPECIAL CARNAUBA WAX No. 1", product of S. Kato & Co.) were loaded into an FM mixer ("FM-20B", product of Nippon Coke & Engineering Co., Ltd.), and mixed together at a rotational speed of 2,400 rpm for 3 minutes. Subsequently, the resultant mixture was melt-kneaded using a twin screw extruder ("PCM-30", product of Ikegai Corp.) under conditions of a material feeding rate of 5 kg/hour, a shaft rotational speed of 150 rpm, and a cylinder temperature of 150° C. The resultant melt-kneaded product was then cooled. Subsequently, the cooled melt-kneaded product was coarsely pulverized using a pulverizer ("ROTOPLEX (registered Japanese trademark)", product of Hosokawa Micron Corporation). The coarsely pulverized product was then finely pulverized using a jet mill ("MODEL-I SUPER SONIC JET MILL", product of Nippon Pneumatic Mfg.). Next, the finely pulverized product was classified using a classifier ("ELBOW JET EJ-LABO", product of Nittetsu Mining Co., Ltd.). Through the above, toner mother particles T1 having a volume median diameter ($D_{50}$) of 8.0 μm were obtained.

<Toner Production>

[Production of Toner TA-1]

An FM mixer ("FM-10B", product of Nippon Coke & Engineering Co., Ltd.) was used to mix 100 parts by mass of the toner mother particles T1, 0.5 parts by mass of silica particles ("AEROSIL (registered Japanese trademark) REA90", product of Nippon Aerosil Co., Ltd., dry silica particles made positively chargeable through surface treatment), and 0.1 parts by mass of the lubricant particles A for 5 minutes under conditions of a rotational speed of 3,500 rpm and a jacket temperature of 20° C. Subsequently, the resultant powder was sifted using a 200-mesh sieve (sieve opening 75 μm). Through the above, a toner TA-1 was obtained that included a number of lubricant particles A and a number of toner particles including the toner mother particles T1 to which the silica particles were attached. Note that the lubricant particles A included in the toner TA-1 were attached to each of the toner mother particles T1.

[Production of Toners TA-2 to TA-9 and TB-1 to TB-4]

Toners TA-2 to TA-9 and TB1- to TB-4 were prepared by the same method as for the toner TA-1 in all aspects other than that the lubricant particles A were changed to respective types of lubricant particles shown in Table 1. Note that values in the column "Thickness (nm)" in Table 1 indicate thicknesses of the coat layers of the respective types of lubricant particles. Also, "-" in the column "Thickness (nm)" in Table 1 indicates that no coat layer was formed.

<Evaluation Method>

For evaluation of each of the toners TA-1 to TA-9 and TB-1 to TB-4, an evaluation developer was prepared by the below-described method and evaluation was performed by the below-described method using an evaluation apparatus ("TASKALFA (registered Japanese trademark) 500ci", product of KYOCERA Document Solutions Inc.). Note that the evaluation apparatus included an amorphous silicon photosensitive member as a photosensitive drum. The evaluation apparatus also included a rubber-made cleaning blade.

[Preparation of Evaluation Developer]

With respect to each of the toners TA-1 to TA-9 and TB-1 to TB-4 produced by the respective methods, 100 parts by mass of a developer carrier (carrier for a color printer "FS-05250DN", product of KYOCERA Document Solutions Inc.) and 5 parts by mass of the toner were mixed together and the resultant mixture was stirred for 30 minutes using a ball mill. As a result of the stirring, evaluation developers (two-component developers) containing the respective toners TA-1 to TA-9 and TB-1 to TB-4 were obtained.

[Evaluation of Charge Stability]

One of the evaluation developers was loaded into a development device for black color of the evaluation apparatus and a corresponding one of evaluation toners (one of the toners produced by the above-described methods) was loaded into a black toner cartridge of the evaluation apparatus. A voltage across a development sleeve and a magnet roll of the evaluation apparatus was adjusted to 250 V to set an alternating current voltage (Vpp) applied to the magnet roll at 2.0 kV. Next, an evaluation image including a solid image at a printing rate of 100% was output on paper (A4-size plain paper) using the evaluation apparatus under environmental conditions of a temperature of 10° C. and a relative humidity of 10%. The solid image at a printing rate of 100% occupied 20% of a printing area of the evaluation image. Next, an image density of the resultant solid image was measured and the measured image density was determined to be an initial image density. The image density was measured using a reflectance densitometer ("SPECTROEYE (registered Japanese trademark)", product of X-Rite Inc.). Subsequently, an image at a printing rate of 4% was continuously printed on 5,000 sheets of paper (A4-size plain paper) using the evaluation apparatus under environmental conditions of a temperature of 10° C. and a relative humidity of 10%. After the continuous printing, an evaluation image including a solid image at a printing rate of 100% was output on paper (A4-size plain paper). The solid image at a printing rate of 100% occupied 20% of a printing area of the evaluation image. Next, an image density of the resultant solid image was measured by the same manner as that described above and the measured image density was determined to be a post-continuous printing image density. An absolute value of a difference between the initial image density and the post-continuous printing image density (also referred to below as an absolute value Δ) was calculated and evaluated based on the following evaluation standards. Evaluation results are shown in Table 1. An evaluation result determined as A indicates that charge stability was excellent. An evaluation result determined as B indicates that charge stability was good. An evaluation result determined as C indicates that charge stability was poor.

(Evaluation Standards)

A: Absolute value Δ was no greater than 0.1.

B: Absolute value Δ was greater than 0.1 and no greater than 0.2.

C: Absolute value Δ was greater than 0.2.

[Evaluation of Cleaning Ability]

One of the evaluation developers was loaded into the development device for black color of the evaluation apparatus and a corresponding one of the evaluation toners (one of the toners produced by the above-described methods) was loaded into the black toner cartridge of the evaluation apparatus. A voltage across the development sleeve and the magnet roll of the evaluation apparatus was adjusted to 250 V to set an alternating current voltage (Vpp) applied to the magnet roll at 2.0 kV. Next, an image at a printing rate of 4% was continuously printed on 5,000 sheets of paper (A4-size plain paper) using the evaluation apparatus under environmental conditions of a temperature of 25° C. and a relative humidity of 50%. After the continuous printing, a solid image at a printing rate of 100% was output on the entirety of paper (A4-size plain paper), and then, a halftone image at a printing rate of 50% was output on the entirety of paper (A4-size plain paper). A visual check was performed to determine whether or not any color spot or any image void was present in the resultant solid image and the resultant halftone image. A visual check was performed to further determine presence or absence of toner components (residue) remaining on the surface of the photosensitive drum after the formation of the solid image and the halftone image. Results of the visual checks were evaluated based on the following evaluation standards. Evaluation results are shown in Table 1. An evaluation result determined as A indicates that impairment in cleaning ability of the cleaning blade was significantly inhibited. An evaluation result determined as B indicates that impairment in cleaning ability of the cleaning blade was inhibited. An evaluation result determined as C indicates that impairment in cleaning ability of the cleaning blade was not inhibited.

(Evaluation Standards)

A: Neither a color spot nor an image void was found in both the solid image and the halftone image, and no toner components remained on the surface of the photosensitive drum.

B: Neither a color spot nor an image void was found in both the solid image and the halftone image, while toner components remained on the surface of the photosensitive drum.

C: A color spot or an image void was found in at least one of the solid image and the halftone image, and toner components remained on the surface of the photosensitive drum.

TABLE 1

| | | Lubricant particles | | | | |
|---|---|---|---|---|---|---|
| | Toner | Type | Thickness (nm) | Number average particle diameter (μm) | Charge stability | Cleaning ability |
| Example 1 | TA-1 | A | 10 | 1.0 | A | A |
| Example 2 | TA-2 | B | 20 | 1.1 | A | A |
| Example 3 | TA-3 | C | 50 | 1.2 | A | B |
| Example 4 | TA-4 | D | 10 | 0.1 | B | A |
| Example 5 | TA-5 | E | 10 | 5.0 | A | A |
| Example 6 | TA-6 | F | 10 | 1.0 | A | B |
| Example 7 | TA-7 | G | 50 | 0.1 | B | B |
| Example 8 | TA-8 | H | 10 | 1.0 | A | A |
| Example 9 | TA-9 | I | 10 | 1.0 | A | A |
| Comparative Example 1 | TB-1 | J | 100 | 1.4 | A | C |
| Comparative Example 2 | TB-2 | K | 5 | 1.0 | C | A |
| Comparative Example 3 | TB-3 | L | 60 | 0.1 | B | C |
| Comparative Example 4 | TB-4 | M | — | 1.0 | C | A |

The toners TA-1 to TA-9 each were a toner including a number of toner particles and a number of lubricant particles. Furthermore, the lubricant particles included in each of the toners TA-1 to TA-9 each included a core containing stearic acid or palmitic acid and a coat layer covering the surface of the core. As shown in Table 1, the thickness of the coat layers of the lubricant particles included in each of the toners TA-1 to TA-9 was at least 10 nm and no greater than 50 nm.

In evaluation of charge stability, the toners TA-1 to TA-9 were evaluated as A (charge stability was excellent) or B (charge stability was good), as shown in Table 1. In evaluation of cleaning ability, the toners TA-1 to TA-9 were evaluated as A (impairment in cleaning ability of the cleaning blade was significantly inhibited) or B (impairment in cleaning ability of the cleaning blade was inhibited).

The coat layers of the lubricant particles included in each of the toners TB-1 and TB-3 had a thickness of greater than 50 nm, as shown in Table 1. The coat layers of the lubricant particles included in the toner TB-2 had a thickness of less than 10 nm. No coat layer was formed on the lubricant particles included in the toner TB-4.

As shown in Table 1, the toners TB-2 and TB-4 were evaluated as C (charge stability was poor) in evaluation of charge stability. Cleaning ability of each of the toners TB-1 and TB-3 was evaluated as C (impairment in cleaning ability of the cleaning blade was not inhibited).

The above results indicated that impairment in cleaning ability of the cleaning member could be inhibited while charge stability could be maintained when the toner according to the present disclosure was used.

What is claimed is:

1. A toner comprising a plurality of toner particles and a plurality of lubricant particles, wherein the lubricant particles each include a core and a coat layer covering a surface of the core, the core contains stearic acid, palmitic acid, or a combination thereof, and the coat layer has a thickness of at least 10 nm and no greater than 50 nm.

2. The toner according to claim 1, wherein the lubricant particles have a number average particle diameter of at least 0.1 μm and no greater than 5.0 μm.

3. The toner according to claim 1, wherein the coat layer includes a first coat layer covering the surface of the core and a second coat layer covering a surface of the first coat layer, and the first coat layer contains a polyamide resin.

4. The toner according to claim 3, wherein the second coat layer contains a polyurea resin or a polymer of a vinyl compound.

5. The toner according to claim 4, wherein the second coat layer is constituted by a polymer of monomer components including divinylbenzene.

6. An image forming method comprising:

developing an electrostatic latent image formed on a surface of an image bearing member into a toner image with a developer;

transferring the toner image to a transfer target; and removing a substance remaining on the surface of the image bearing member using a cleaning member in pressure contact with the surface of the image bearing member after the transferring the toner image, wherein the developer contains the toner according to claim 1.

* * * * *